US005666624A

United States Patent [19]

Kanesawa et al.

[11] Patent Number: 5,666,624

[45] Date of Patent: Sep. 9, 1997

[54] IMAGE FIXING DEVICE

[75] Inventors: Yoshio Kanesawa; Yasuhiro Uehara, both of Nakai-machi, Japan

[73] Assignee: Fuji Xerox Co., Ltd., Tokyo, Japan

[21] Appl. No.: 645,565

[22] Filed: May 14, 1996

[30] Foreign Application Priority Data

May 16, 1995 [JP] Japan ..... 7-117402
Apr. 12, 1996 [JP] Japan ..... 8-115668

[51] Int. Cl.[6] ..... G03G 15/20

[52] U.S. Cl. ..... 399/329; 219/216; 399/333

[58] Field of Search ..... 355/285, 290; 219/216; 432/59, 60; 118/60; 430/124

[56] References Cited

U.S. PATENT DOCUMENTS

| | | | |
|---|---|---|---|
| 5,264,902 | 11/1993 | Suwa et al. | 355/285 X |
| 5,345,300 | 9/1994 | Uehara et al. | 355/285 |
| 5,359,401 | 10/1994 | Uehara et al. | 355/285 |

FOREIGN PATENT DOCUMENTS

| | | |
|---|---|---|
| 52-69337 | 6/1977 | Japan . |
| U-60-104852 | 7/1985 | Japan . |
| A-60-151677 | 8/1985 | Japan . |
| A-60-151681 | 8/1985 | Japan . |
| A-62-14675 | 1/1987 | Japan . |
| U-2-30961 | 2/1990 | Japan . |
| A-2-222982 | 9/1990 | Japan . |
| A-2-308287 | 12/1990 | Japan . |
| U-3-86374 | 8/1991 | Japan . |
| U-3-92661 | 9/1991 | Japan . |
| A-4-50885 | 2/1992 | Japan . |
| A-4-115279 | 4/1992 | Japan . |
| U-4-50864 | 4/1992 | Japan . |
| A-5-150679 | 6/1993 | Japan . |

*Primary Examiner*—Arthur T. Grimley
*Assistant Examiner*—Sophia S. Chen
*Attorney, Agent, or Firm*—Oliff & Berridge

[57] ABSTRACT

An image fixing device for heating and applying pressure to a toner image on a recording medium to melt and press the toner image on the recording medium, having: a heating and fixing roll for heating the recording medium; a device for rotating and driving the heating and fixing roll; an endless belt arranged with respect to the recording medium on the side opposite to the heating and fixing roll; and a pressure applying member in contact with an inner surface of the endless belt and being provided with a pressing surface for pressing the endless belt against the heating and fixing roll along the surface of the heating and fixing roll; wherein pressure exerting on the pressing surface of the pressure applying member is set to a value of or above pressure for suppressing a volume expansion of gas caused by a rise in temperature of the gas taken between the heating and fixing roll and the endless belt.

20 Claims, 9 Drawing Sheets

IMAGE FIXING DEVICE

BACKGROUND OF THE INVENTION

1. Field of the Invention

The present invention relates, in an image forming apparatus making use of an electronic photographic system such as a copier, a printer and a facsimile, to an image fixing device for heating and fixing a non-fixed toner image, and particularly to an image fixing device of a belt nip system.

2. Description of the Related Art

FIG. 12 shows an image fixing device proposed by the applicant of the present invention and disclosed in Japanese Patent Laid-Open No. Hei 5-150679 (1993). In the figure, reference numeral 101 designates a heating and fixing roll rotatably arranged. This heating and fixing roll 101 has a cylindrical core 103 formed of metal having a high heat conductivity such as aluminum, and a coating layer 104 formed of an elastic member formed on the surface thereof. The coating layer 104 comprises a primary coating layer 120 formed of HTV (High Temperature Vulcanization) silicon rubber directly coated on the surface of the core 103 and a top coating layer 121 formed of RTV (Room Temperature Vulcanization) silicon rubber coated externally thereof.

A halogen lamp 105 as a heating source is arranged within the core 103. A temperature sensor 106 is arranged on the surface of the heating and fixing roller 101 to measure the temperature of said surface. A temperature controller not shown is actuated by a measurement signal of the temperature sensor 106 to control turn-on and off of the halogen lamp 105 so that the surface temperature of the heating and fixing roll 101 is adjusted. Silicon oil as a release medium is supplied to the surface of the heating and fixing roll 101 by an oil supply device 109 whereby when an image of toner 108 is fixed to a sheet 107, a part of the toner 108 is prevented from being offset to the heating and fixing roll 101.

In the above image fixing device, a pressure roll 125 is pressed against the heating and fixing roll 101 by means of a compression spring 126. Further, a pressure auxiliary roll 129 is pressed toward the heating and fixing roll 101. Rolls 122, 123 and 124 are arranged in the periphery of the pressure roll 125 and the pressure auxiliary roll 129. An endless belt 115 is wound around the rolls 122, 123 and 124, the pressure roll 125 and the pressure auxiliary roll 129.

The pressure roll 125 and the pressure auxiliary roll 129 are pressed against the heating and fixing roll 101 whereby the endless belt 115 comes in contact with the heating and mixing roll 101 to form a nip (a belt nip) for causing the sheet 107 to pass through between the heating and fixing roll 101 and the endless belt 115. The heating and fixing roll 101 and the endless belt 115 rotate as indicated by the arrows respectively and the sheet 107 is carried between the heating and fixing roll 101 and the endless belt 115. When the sheet 107 passes through the belt nip, the non-fixed toner 108 is fixed onto the sheet 107 by the pressure exerting on the belt nip and the heat applied through the heating and fixing roll 101 from the halogen lamp 105.

By employing the construction of the belt nip system as described, the sheet 107 is heated for a period of time corresponding to the width of the belt nip (in the illustrated example, the length of the belt held by the pressure roll 125 and the pressure auxiliary roll 129). This leads to the advantage in that even if the carrying speed of the sheet 107 is increased, it is possible to secure a sufficient fixing time as compared with the case where only the pressure roll and the heating and fixing roll 101 are pressed and the endless belt 115 is not used. Further, if the carrying speed is the same, the heating time in the belt nip system is longer than that in the system not using the endless belt 115 and a large quantity of heat can be given by the toner. Therefore, the belt nip system is suitable particularly for fixing in a color copier which colors a large quantity of toner to a color as desired.

Further, in this image fixing device, the surface of the heating and fixing roll 101 is formed with the coating layer 104 formed of silicon rubber which is an elastic member so that the coating layer 104 receives the pressing force of the pressure roll 125 so as to be locally flexed in a pressing area. That is, since the surface speed of the coating layer 104 is locally high, a fine deviation occurs between the sheet 107 and the coating layer 104 in the pressing area of the pressure roll 125. Further, the toner 108 in a high temperature state tends to be adhered to the coating layer 104, but such a deviation leads to a fine slip in an interface between the toner 108 and the coating layer 104 to prevent the toner 108 from being deposited on the coating layer 104.

Thereby, the sheet 107 is separated from the heating and fixing roll 101 against the adhesive force between the toner 108 and the heating and fixing roll 101. Since the adhesive force of the melted toner to the heating and fixing roll 101 is governed even by the property value of the interface chemical material of both elements, the behavior in which the sheet 107 is stripped varies with kinds of toner and materials of the coating layer 104. However, according to this image fixing device, the sheet 107 can be stripped from the heating and fixing roll 101 even if a stripping means such as a stripper claw is not used (this will be hereinafter called self-stripping). Because of this, a sheet which is easily bent and hard to be stripped or a sheet to which a large amount of toner adhered can be subjected to self-stripping.

Other image fixing devices employing the belt nip system are disclosed in Japanese Patent Laid-Open Nos. Sho 52-69337 (1977), Sho 60-151677 (1985), Sho 60-151681 (1985), Sho 62-14675 (1987) Hei 2-222982 (1990), Hei 2-308287 (1990), Hei 4-50885 (1992) and Hei 4-115279 (1992), and Japanese Utility Model Laid-Open Nos. Sho 60-104852 (1985), Hei 2-30961 (1990), Hei 3-86374 (1991), Hei 3-92661 (1991) Hei 4-50864 (1992).

However, the aforementioned belt nip system image fixing device has the following problems. That is, in the case where the toner 108 of a heat fusion type which is now in the main current is used, the sheet 107 has to be necessarily heated to fuse the toner 108 to the sheet 107. At the time of heating as described, air becomes thermally expanded or water vapor becomes evaporated from a gap between fibers of the sheet 107 or a gap between toner particles. Such air or water vapor is generated when the sheet 107 is heated within the belt nip, is present as foam within the belt nip, concretely between the sheet 107 and the heating and fixing roll 101 or the endless belt 115 till the sheet 107 passes through the belt nip, and is discharged outside at the same time when the sheet 107 has passed through the belt nip. Within the belt nip, an area which is small in pressing force is widely present between the pressing portion by the pressure roll 125 and the pressing portion by the pressure auxiliary roll 129, as shown in FIG. 13, and when the foam is present in this area, a gap is sometimes produced between the heating and fixing roll 101 and the endless belt 115. When such a gap is produced, in the state where the toner 108 on the sheet 107 within the belt nip is not yet fixed, the non-fixed toner 108 becomes moved by the movement of the foam. This leads to a problem in that blur, deviation, disturbance, etc. occurs in the image.

FIG. 14 is a graph showing the results of measurement of the gap produced between the heating and fixing roll 101 and the endless belt 115 in the central portion of the belt nip, that is, in the intermediary between the pressure roll 125 and the pressure auxiliary roll 129 in fixing the image of the non-fixed toner 108 with the device shown in FIG. 12. Sheets used are J sheets of A3 Format manufactured by Fuji Xerox Co., Ltd. The gap is obtained by measuring a spacing between the heating and fixing roll and the endless belt and subtracting the thickness of the sheet from the measured value. As will be apparent from the results shown in FIG. 14, when the temperature of the fixing roll is approximately the environmental temperature, no gap is produced but when the temperature of the fixing roll is made higher, the gap produced between the heating and fixing roll 101 and the endless belt 115 becomes larger. This results from the thermal expansion of air or water vapor. That is, since the pressing force of the endless belt relative to the heating and fixing roll caused by belt tension is small, the gap is produced because the thermal expansion of air or water vapor cannot be suppressed.

Accordingly, the pressure roll and the pressure auxiliary roll have to apply a load enough to suppress the thermal expansion of air or water vapor not to produce a gap.

However, in a portion where the pressing force is small, that is, in the intermediary between the pressure roll 125 and the pressure auxiliary roll 129, a gap tends to be produced between the heating and fixing roll 101 and the endless belt 115 not to apply pressure enough to prevent the movement of the non-fixed toner 108. In the system which uses the heating and fixing roll and the pressing and fixing roll but does not use the endless belt, since pressure is high, such an inconvenience less occurs. However, in the belt nip system, since pressure is low, there is a great possibility in that an image of the toner 108 is disturbed by the foam. In the actual case, blur, deviation and disturbance of an image which are considered to be resulted from foam occur.

SUMMARY OF THE INVENTION

This invention has been achieved in consideration of the above-described problems. An object of the invention is to provide an image fixing device which can fix a toner image while preventing a disturbance of the toner image caused by expansion of air and occurrence of water vapor within a so-called belt nip.

For achieving the above-described problems, according to one aspect of the present invention, there is provided an image fixing device for heating and applying pressure to a toner image on a recording medium to melt and press the toner image on the recording medium, comprising: a heating and fixing roll for heating the recording medium rotating and driving means for rotating and driving the heating and fixing roll; an endless belt arranged with respect to the recording medium on the side opposite to the heating and fixing roll; and a pressure applying member in contact with the inner surface of the endless belt and being provided with a pressing surface for pressing the endless belt against the heating and fixing roll along the surface of the heating and fixing roll, wherein pressure exerting on the pressing surface of the pressure applying member is set to a value of or above pressure for suppressing a volume expansion of gas caused by a rise in temperature of the gas taken between the heating and fixing roll and outer surface of the endless belt.

In the thus configured image fixing device, the pressing surface of the pressure applying member is pressed against the surface of the heating and fixing roll through the endless belt, and the endless belt is widely pressed in a circumferential direction of the heating and fixing roll. The pressure exerting on the pressing surface of the pressure applying member is set to a level in excess of a value capable of suppressing the thermal expansion of air or water vapor between recording sheets or toner particles whereby occurrence or growth of foams within the belt nip can be suppressed and a non-fixed toner can be prevented from being disturbed by the thermally expanded foams.

In order to prevent the gap from being produced between outer surface of the endless belt and the heating and fixing roll, the belt is pressed against the heating and fixing roll by the pressure applying member to elevate pressure Pn within the nip to suppress an increase in volume of air or water vapor. Thus, since a toner image can be fixed while preventing the disturbance of the toner image in this manner, it is possible to prevent the fixed image from occurrence of the disturbance of blur or desolation. This pressure Pn can be realized specifically as in formula (1):

$$Pn \geqq Po(Tn/To-1) \quad (1)$$

wherein Tn is a temperature of the heating and fixing roll, To is a temperature of air (environmental temperature) at a position sufficiently away from the heating and fixing roll, and Po is atmospheric pressure.

The followings are obtained from formula (1). Equation of state (2) of ideal gas is as follows.

$$PV=nRT \quad (2)$$

Accordingly, equations (3) and (4) are obtained as follows:

$$(Po+Pn)Vn=nRTn \quad (3)$$

$$PoVo=nRTo \quad (4)$$

wherein Vn is a volume of air within the belt nip, and Vo is a volume of air outside the belt nip. To suppress the expansion of air within the belt nip, there should be $Vn \leqq Vo$. From this, formula (5) is given.

$$Tn/(Po+Pn) \leqq To/Po \quad (5)$$

When formula (5) is modified, formula (1) is obtained.

In the above-described invention, the endless belt may take suitable configurations. For example, an endless belt is stretched over a plurality of rolls or an endless belt is supported in a non-tension state. The support of the endless belt in the non-tension state has an advantage in that stretching members such as support rolls are not necessary.

It is desirable that a suitable material is used for the pressing surface of the pressure applying member. For example, selection can be made of an arrangement wherein the pressing surface is formed of a material having a heat resistance and fine rugged portions are formed on approximately the whole surface or an arrangement wherein the pressing member is formed of a member in which heat resistant resins are impregnated in cloth formed of heat resistant fibers. Accordingly, by setting the material of the pressure applying member adequately, the running speed of the endless belt can be matched to the rotational speed of the heating and fixing roll. Further, it is desirable that a frictional coefficient $\mu_2$ between the pressure applying member and inner surface of the endless belt is smaller than a frictional coefficient $\mu_1$ between the heating and fixing roll and outer surface of the endless belt. Thereby, the endless belt is not stopped by the pressure applying member but can be run following the rotation of the heating and fixing roll. Accordingly, for example, it is possible to suppress an inconvenience such that only the heating and fixing roll is rotated and the toner on the sheet is rubbed by the heating and fixing roll to disturb an image.

A pressing member for pressing the endless belt against the heating and fixing roll may be disposed at downstream of the pressure applying member in the rotational direction of the heating and fixing roll so as to strain an elastic layer of the heating and fixing roll. Thereby, it can be prevented that the surface speed of the elastic layer is locally increased to produce a fine slip in an interface between a sheet and toner, causing adhesion of the toner. Accordingly, the sheet can be easily stripped from the heating and fixing roll, thus making a so-called self-stripping possible.

Further, it is desirable that the pressing member is supported integral with the pressure applying member and the range in which the pressing member is pressed against the heating and fixing roll and the range in which the pressure applying member is pressed against the heating and fixing roll are generally continuous to the circumferential direction of the heating and fixing roll. Thereby, the pressing portion of the belt nip area can be formed widely in the circumferential direction, and a portion whose pressing force in the nip area becomes small can be eliminated. Further, by arranging the pressing member and the pressure applying member in the non-rotational state, heat loss is reduced, and the lowering of temperature of the belt nip is also reduced. Accordingly, the disturbance of an image caused by thermal expansion of air or water vapor contained between the sheets or toner particles can be prevented.

On the other hand, it is desirable that the circumferential length of the heating and fixing roll in which the pressure applying member presses the endless belt against the heating and fixing roll is set from a position at which the endless belt is placed in contact with the heating and fixing roll to a position at which the viscosity of the toner is heated to a temperature at which a visco-elastic flow occurs. This results from the following function.

When the toner borne on the sheet is moved into the nip, it is heated by the heating and fixing roll to increase the temperature. When reaching a certain temperature, the toner particles shift from the glass state to the state in which the visco-elastic flow occurs, and in this state, the adhesive force between the toner particles is generated so that the toner particles are not easily moved. Accordingly, the disturbance of the image tends to occur in the area to be heated to the above temperature, and the pressure applying member is pressed against the aforesaid portion to effectively prevent the disturbance of the image.

It is further desirable that the circumferential length of the heating and fixing roll in which the pressure applying member presses the endless belt against the heating and fixing roll is ½ or more of the circumferential length of the heating and fixing roll till the endless belt is moved away after the former has been placed in contact with the heating and fixing roll. This results from the following function.

Generally, the heating temperature suitable for fixing is set to a temperature corresponding to the state having an adequate flowability. In heating by the heating and fixing roll to said temperature, the toner shifts from the glass state to the state where the visco-elastic flow occurs in the heating time about ½ thereof. Accordingly, the range of ½ till the sheet is finally fixed after being pressed by the nip is an area where the disturbance of the image tends to occur. The disturbance of the image is effectively prevented by placing said portion in pressure contact with the pressure applying member. In the image fixing device as described, even if a low pressure area is present between the pressing portion by the pressure applying member in the nip area and the pressing portion by the pressing member, the deviation or disturbance of a toner image can be prevented. Ideally, however, it is preferable that no low pressure area is present between the pressing portion by the pressure roll in the nip area and the pressing portion by the pressure applying member.

DESCRIPTION OF THE PREFERRED EMBODIMENTS

The preferred embodiments of the present invention will be described hereinafter with reference to the drawings.

Figure 1:
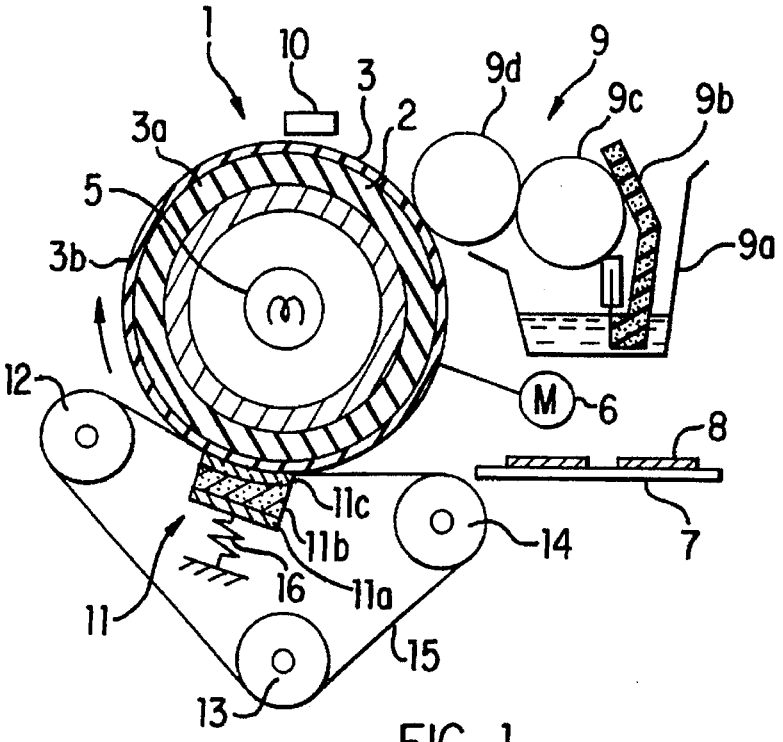
FIG. 1 is a schematic structural view of an image fixing device in a first embodiment according to the present invention.

FIG. 1 is a schematic structural view of an image fixing device in a first embodiment according to the present invention.

The image fixing device has a main portion comprising a heating and fixing roll 1 having a heating source encased therein, an endless belt 15 stretched over three support rolls 12, 13 and 14 and pressed against the heating and fixing roll 1, and a pressure applying member 11 placed in contact with the inner surface of the endless belt, for pressing the endless belt 15 along the surface of the heating and fixing roll The heating and fixing device 1, which is interiorly provided with a cylindrical core 2, is rotated circumferentially by means of a motor 6. The core 2 is formed of aluminum and has 47 mm of an outer diameter, 2 mm of an inner diameter and 350 mm of a length. A primary layer 3*a* having a thickness of 2 mm formed of HTV silicon rubber having a hardness 45° (JIS-A) is directly coated on the surface of the core 2 and a top coat layer 3*b* having a thickness of 50 μm formed of RTV silicon rubber is further dip-coated thereon. With this, a coating layer 3 is formed, the coating layer 3 being finished to have the surface close to a mirror state. The hardness of the primary layer 3*a* results from the measurement by applying a load of 1,000 gf in accordance with JIS K6301 by an A-type hardness tester of a spring type manufactured by Teclock Ltd. The core 2 can be made of metal having a high heat conductivity instead of aluminum, and the coating layer 3 can be formed of other materials if they are elastic materials having a high heat resistance.

A halogen lamp 5 having an output of 850 W as a heating source is arranged within the core 2. A temperature sensor 10 is arranged on the surface of the heating and fixing roll 1 to measure the temperature of said surface. The halogen lamp 5 is feedback-controlled by a temperature controller not shown according to a measuring signal of the temperature sensor 10 so as to adjust the temperature of the surface of the heating and fixing roll 1 to 150° C.

An oil supply device 9 is disposed in the vicinity of the heating and fixing roll 1. The oil supply device 9 always supplies a constant amount of a release agent to the surface of the heating and fixing roll 1 through a sponge-like suction member 9*b*, and rolls 9*c* and 9*d* from a tank 9*a* storing the release agent therein. With this, when an image of non-fixed toner 8 is fixed to a sheet 7, a part of the toner 8 is prevented from being offset to the heating and fixing device 1. As the release agent to be supplied by the oil supply device 9, dimethyl silicon oil (Product Name "KF-96") having a viscosity 1000 cs manufactured by Shin-Etsu Chemical Co., Ltd. is used.

The pressure applying member 11 is formed by laminating an elastic layer 11*b* and a low friction layer 11*c* on the surface of a base plate 11*a*, and is pressed toward the heating and fixing roll 1 by means of a compression spring 16 arranged on the side of the base plate 11*a*. The base plate 11*a* is formed of stainless steel having 20 mm of a width (running direction of the belt), 320 mm of a length (vertical direction of paper surface) and 5 mm of a thickness. The elastic layer 11*b* is formed of silicon sponge of rubber hardness of 23° (foam body of silicon rubber) and having 5 mm of a thickness. The rubber hardness results from the measurement applying a load of 300 gf by a rubber hardness tester for sponge of Asker C type manufactured by High-polymer Science Co., Ltd. Further, as the low friction layer 11*c*, a fibrous glass sheet impregnated with polytetrafluoroethylene, "FGF-400-4," (Product Name), manufactured by Chuko Kasei Co., Ltd. is used.

By the provision of the elastic layer 11*b*, the contact surface of the low friction layer 11*c* in contact with the endless belt 15 can be matched with the outer peripheral surface of the heating and fixing roll 1. That is, if the pressure applying member 11 is pressed toward the heating and fixing roll 1 by the load in excess of a predetermined value, the elastic layer 11*b* is strained, and the contact surface of the low friction layer 11*c* is strained so as to be pressed along the outer peripheral surface of the heating and fixing roll 1. Accordingly, when the pressure applying member 11 is pressed against the heating and fixing roll 1 by means of the compression spring 16, the endless belt 15 is pressed against the heating and fixing roll 1 without clearance.

Dimethyl silicon oil (Product Name "KF-96": Shin-Etsu Chemical Co., Ltd.) having a viscosity of 1000 cs is coated on the surface of the low friction layer 11*c* to thereby reduce the frictional coefficient between inner surface of the endless belt 15 and the pressure applying member 11. In the state where the dimethyl silicon oil is coated, the frictional coefficient $\mu_2$ between the pressure applying member 11 and inner surface of the endless belt 15 is smaller than the frictional coefficient $\mu_1$ between the heating and fixing roll 1 and outer surface of the endless belt 15. As described above, the frictional coefficients in both surfaces of the endless belt 15 are set whereby the endless belt 15 can run while sliding on the pressure applying member 11 as the heating and fixing roll 1 rotates.

The endless belt 15 is formed of a polyimide film to have 75 μm of a thickness, 300 mm of a width, and 188 mm of a circumferential length. The endless belt 15 is wound around the support rolls 12, 13 and 14 arranged at positions away from the heating and fixing roll 1 by tension of about 8 kgf. The support rolls 12, 13 and 14 are formed of stainless steel, and diameters thereof are 18 mm, 18 mm and 23 mm, respectively.

The endless belt 15 is pressed in close contact with the heating and fixing roll 1 by the pressing of the pressure applying member 11 toward the heating and fixing roll 1. The contact pressure of the pressure applying member 11 is set to approximately 0.56 kgf/cm$^2$. The heating and fixing roll 1 is rotated at circumferential speed of V=220 mm/sec by means of a motor 27. This rotation causes the endless belt 15 to rotate at speed of 220 mm/sec.

Next, the operation of the above-described image fixing device will be described.

In the above-described image fixing device, on the right side in FIG. 1, an image of the toner 8 is transferred onto the sheet 7 by a transfer device not shown, and the sheet 7 is conveyed toward the belt nip. The sheet 7 is moved into the position at which the pressure applying member 11 is arranged. The image of the toner 8 is fixed to the skeet 7 by the pressure exerting on the belt nip and the heat applied through the heating and fixing roll 1 by the halogen lamp 5.

In the case where the pressure within the belt nip is not sufficient as in prior art, the sheet 7 is heated during the passage thereof through the belt nip whereby air or water vapor contained between the fibers of the sheet 7 and between the particles of the toner 8 become expanded or evaporated to be leached between the sheet 7 and the heating and fixing roll 1. The air and water vapor are changed into foams within the belt nip to stir the non-fixed toner 8.

Figure 2:
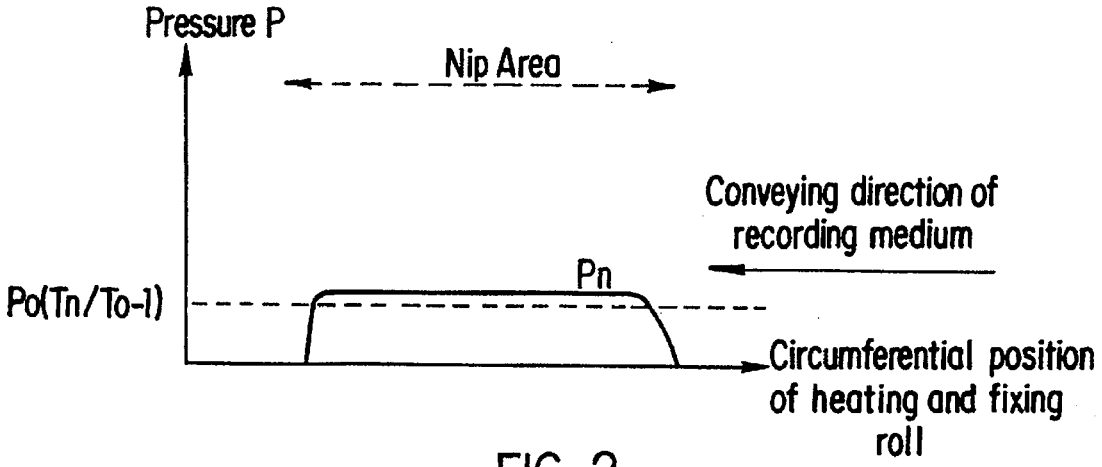
FIG. 2 is a view showing the pressure distribution acting on a belt nip area of the image fixing device shown in FIG. 1.

However, in the image fixing device in this embodiment, the endless belt 15 is urged toward the heating and fixing roll 1 by the contact surface of the pressure applying member 11, and the contact surface can be substantially matched to the outer peripheral surface of the heating and fixing roll 1. Accordingly, as shown in FIG. 2, the endless belt 15 can be pressed against the heating and fixing roll 1 without clearance to thereby suppress the expansion of air and water vapor from the sheet 7 and the toner 8. Because of this, it is possible to suppress the generation and growth of foams within the belt nip, and the non-fixed toner 8 can be prevented from being starred by the grown foams.

At the same time, the contact surface of the pressure applying member 11 can impart the pressing force acting between outer surface of the endless belt 15 and the heating and fixing roll 1 over the large area to be able to positively hold and fix the toner 8 on the sheet 7 passing through the belt nip by outer surface of the endless belt 15 and the heating and fixing roll 1. In this manner, the toner image can be fixed while preventing the disturbance of the toner image. That is, it is possible to prevent blur, deviation and disturbance from being produced in the fixed image.

Figure 3:
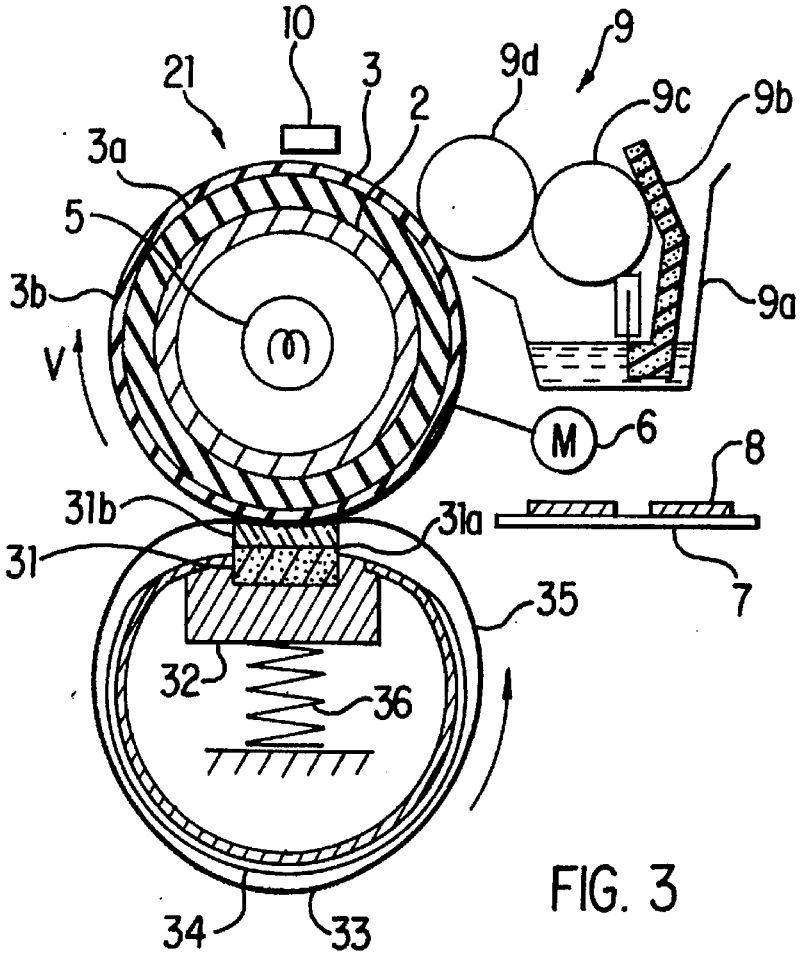
FIG. 3 is a schematic structural view of an image fixing device in a second embodiment according to the present invention.

FIG. 3 is a schematic structural view of an image fixing device in a second embodiment according to the present invention.

This image fixing device is different from the image fixing device shown in FIG. 1 in the manner of supporting an endless belt 35 and a pressure applying member 31. That is, in the image fixing device shown in FIG. 1, the endless belt 15 is stretched by the three support rolls 12, 13 and 14, but in this embodiment, the endless belt 35 is pressed against the heating and fixing roll by the pressure applying member 31 under non-tension state. This pressure applying member 31 is mounted on a support member 32, which are pressed against a heating and fixing roll 21 by means of a spring 36, and comprises an elastic layer 31*a* mounted on the support member 32 and a low friction layer 31*b* on the surface thereof.

A guide member 33 for guiding the endless belt 35 is mounted on the support member 32, and a projecting portion 34 is formed on the surface thereof in the circumferential direction. The endless belt 35 is not applied with tension outside the nip area and the endless belt 35 runs around the guide member 33 as the heating and fixing roll 21 rotates. The endless belt 35 is formed of nickel having a thickness of 30 μm and is strained, in a portion sandwiched between the heating and fixing roll 1 and the pressure applying member 31, according to the shape of the pressing surface therebetween. However, the endless belt 35 may be formed of other metal if the latter has a flexibility.

While the guide member 33 is generally circular adjusting to the shape of the endless belt 35, it is to be noted that other shapes may be employed if they do not obstruct the running of the endless belt 35. For example, an oval can be employed. Further, as materials for the guide member 33, a variety of materials can be used if they have a rigidity to some extent, do not excessively rub the heat from the belt nip and do not obstruct the running of the endless belt 35. For example, the guide member 33 can be formed of wire netting or resins.

Other constructions of this image fixing device is the same as those of the image fixing device shown in FIG. 1.

In such an image fixing device as described, the endless belt 35 rotates as the heating and fixing roll 21 rotates. The endless belt 35 is formed of metal and has a higher rigidity than that of the endless belt 15 shown in FIG. 1 which is made of a polyimide film. Therefore, even if tension is not applied by the roll, no waving or crease occurs. Accordingly, the conventional rolls used to stretch the endless belt can be eliminated to considerably simplify and miniaturize the device, and reduce the cost.

Figure 4:
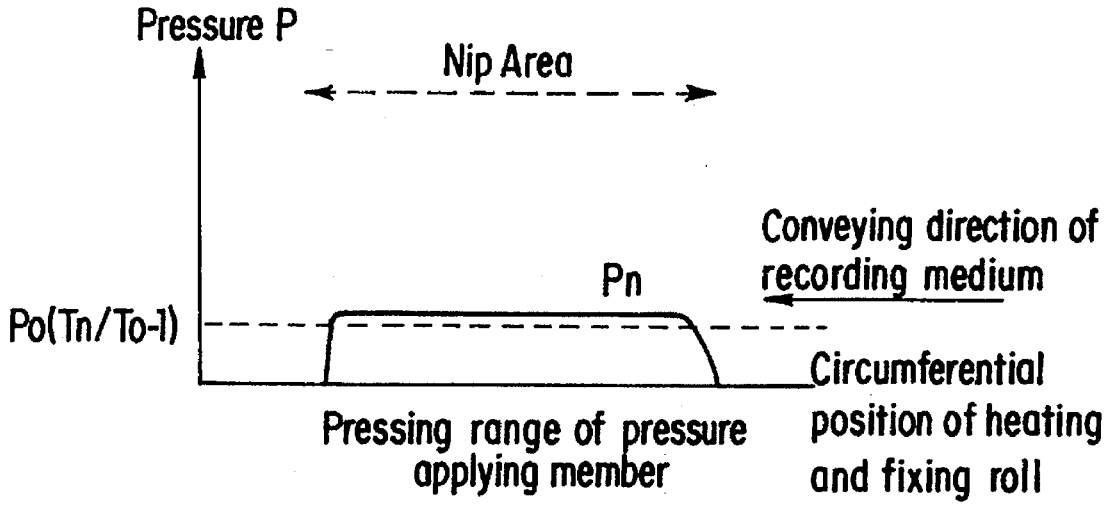
FIG. 4 is a view showing the pressure distribution acting on a belt nip area of the image fixing device shown in FIG. 3.

The contact surface of the pressure applying member 31 is strained adjusting to the outer peripheral surface of the heating and fixing roll 21 whereby the endless belt 35 is pressed against the heating and fixing roll 21 over the wide range without clearance as shown in FIG. 4. The contact pressure by the pressure applying member 31 is set to 0.56 kgf/cm$^2$ whereby the pressure Pn within the belt nip is 0.56 kgf/cm$^2$. Accordingly, no low pressure portion occurs within the belt nip, and the thermal expansion of air and water vapor can be suppressed to prevent a deviation or disturbance of the toner image.

Figure 5:
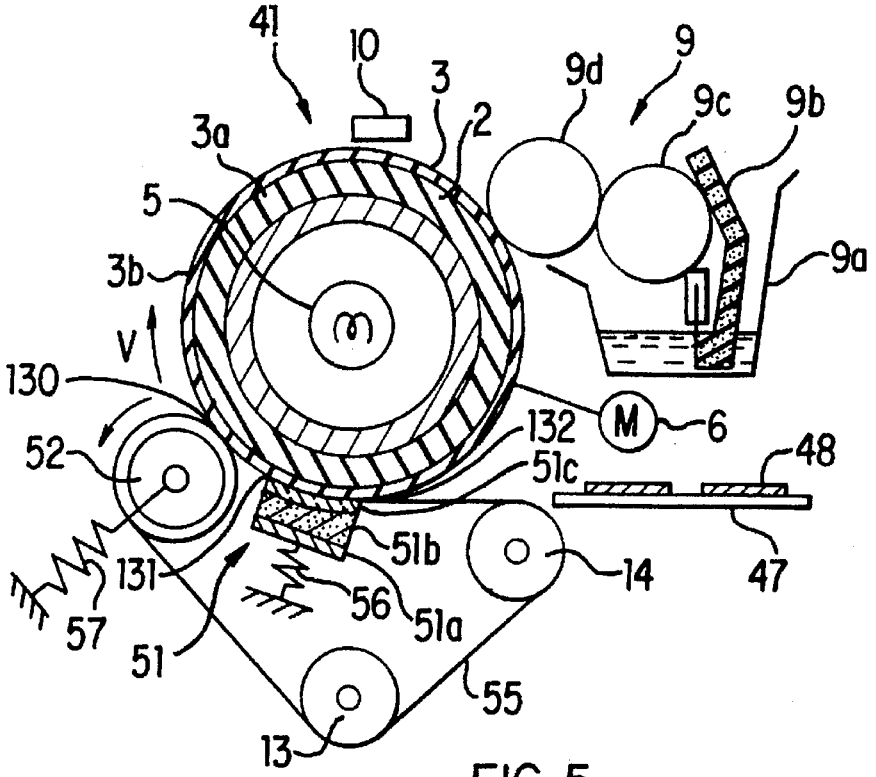
FIG. 5 is a schematic structural view of an image fixing device in a third embodiment according to the present invention.

FIG. 5 is a schematic structural view of an image fixing device in a third embodiment according to the present invention.

This image fixing device is different from the image fixing device shown in FIG. 1 in the construction of the rolls for supporting an endless belt 55. While in the image fixing device shown in FIG. 1, the endless belt 15 is stretched by the three support rolls 12, 13 and 14, it is noted that in this embodiment, a pressure roll 52 as a pressing member is disposed in place of the support roll 12, and the endless belt 55 is pressed against a heating and fixing roll 41.

The pressure roll 52 is provided downstream of a pressure applying member 51 an the rotational direction of the heating and fixing roll 41 and is pressed against the heating and fixing roll 41 by means of a coil spring 57 with a load of approximately 16 kgf. Thereby, an elastic layer 43 of the heating and fixing roll 41 is locally strained. The endless belt 55 is pressed against the heating and fixing device 41 by the pressure roll 52 and the pressure applying member 51. With this arrangement, an winding angle of the endless belt 55 to the heating and fixing roll 41 is 45°. In this case, the width of the belt nip is 20 mm.

It is further desirable that the circumferential length of said heating and fixing roll in which said pressure applying member presses said endless belt against said heating and fixing roll, the circumferential length of said heating and fixing roll till said endless belt is moved away after the pressure applying member has been placed in contact with said heating and fixing roll, as represented by points 130 and 132.

The pressure applying member 51 is formed by laminating an elastic layer 51*b* and a low friction layer 51*c* on a base plate 51*a* having 15 mm of a width in the running direction of the belt. The width of the contact surface of the low friction layer 51*c* (measuring in the running direction of the belt) in the belt nip is about 12 mm. The axial length of the contact between the heating and fixing roll 41 and outer surface of the endless belt 55 is 300 mm. The contact load of the pressure applying member 51 is set to 20 kgf, and since the width of the contact surface is 12 mm, the contact pressure of the pressure applying member 51 is 0.56 kgf/cm$^2$.

The frictional coefficient $\mu_2$ between the pressure applying member 51 and inner surface of the endless belt 55 is set to be smaller than the frictional coefficient $\mu_1$ between outer surface of the endless belt 55 and the heating and fixing roll 41. Thereby, the endless belt 55 can run while sliding on the pressure applying member 51 as the heating and fixing roll 41 rotates. The difference $\Delta\mu$ between the frictional coefficient $\mu_1$ and the frictional coefficient $\mu_2$ takes preferably a larger value, the difference $\Delta\mu$ being described later.

Figure 6:
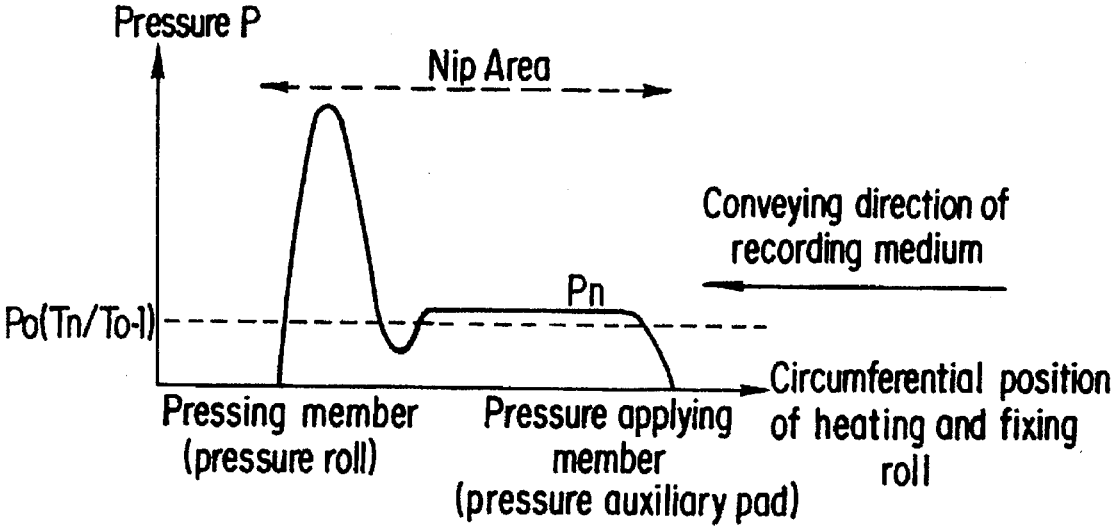
FIG. 6 is a view showing the pressure distribution acting on a belt nip area of the image fixing device shown in FIG. 5.

Other constructions of this image fixing device are the same as those of the image fixing device shown In such an image fixing device as described, when the heating and fixing roll 41 is rotated, the endless belt 55 circumferentially rotates accordingly. A sheet 47 bearing non-fixed toner 48 is fed into the belt nip. At this time, the circumferential speed of the heating and fixing roll 41 and the endless belt 55 is 220 mm/sec. Within the belt nip, the pressure applying member 51 is pressed against the pressure roll 52 whereby the pressure distribution is as shown in FIG. 6 to produce an range in which the pressing force becomes small after passing through an area pressed by the pressure applying member 51.

Figure 7A:
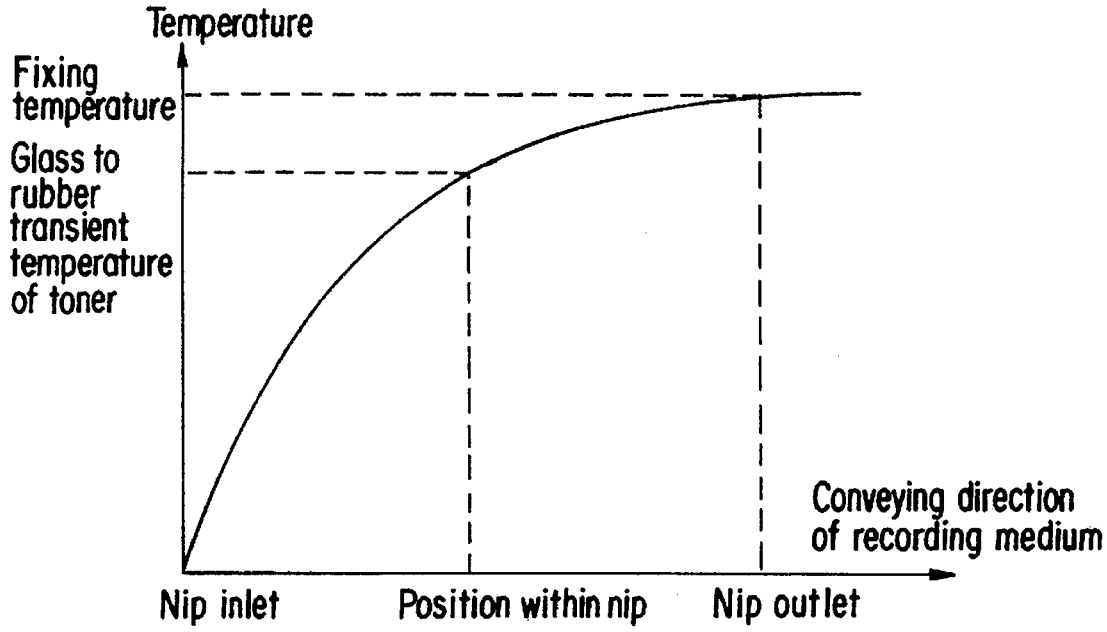
FIGS. 7A and 7B are graphs showing a temperature and a viscous rate of a toner within the belt nip in the image fixing device shown in FIG. 5 respectively.
Figure 7B:
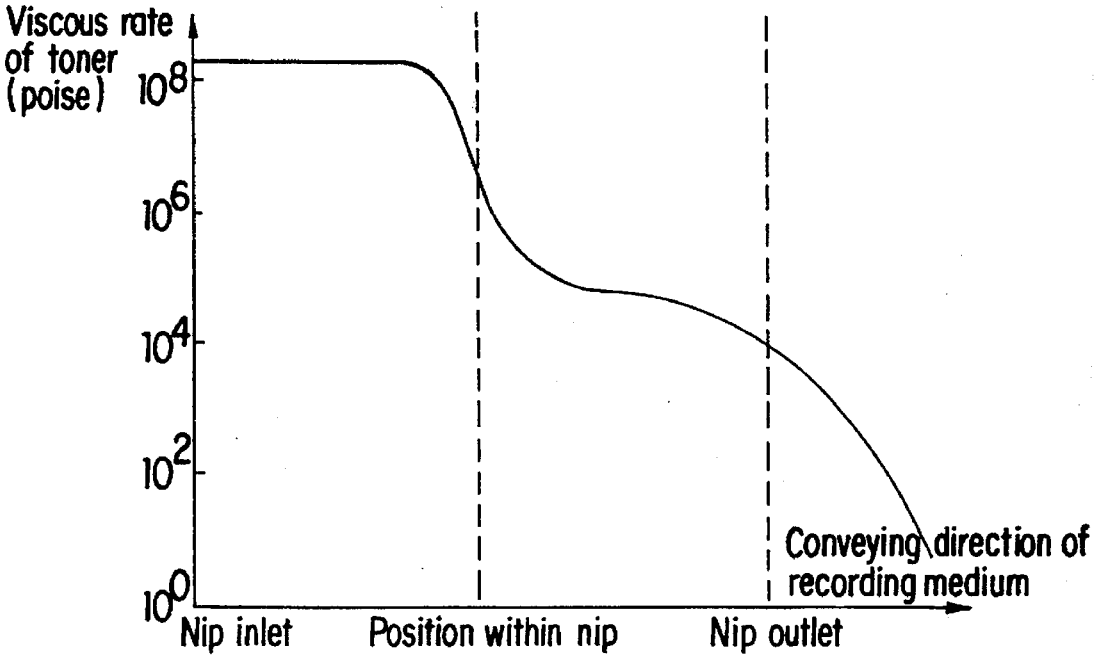

The toner 48 on the sheet 47 shows the following behavior during the passage thereof through the belt nip. As shown in FIG. 7A, the toner 48 on the sheet 47 is heated during the passage thereof through the belt nip, and in the vicinity of the central portion of the belt nip (position about 10 mm from the nip inlet), the toner 48 is heated to the neighborhood of a transient temperature to a state which produces a visco-elastic flow from a glass-like state. Therefore, as shown in FIG. 7B, the viscous rate of the toner rapidly reduces so that the toner assumes a state which produces a visco-elastic flow. Accordingly, even if it passes through an area where the pressing force of the endless belt is small, the toner is n moved not producing the disturbance of the image or the like. The toner 48 is further heated within the belt nip, and the toner 48 is fused to the sheet 47 by the pressure acting on the belt nip.

The heating and fixing roller 41 is locally strained at the position opposite to the pressure roll 52, and the surface speed at the strained portion locally increases so that a deviation between the sheet 47 and the heating and fixing roller 41 occurs. By this deviation, a fine slip occurs in an interface between the toner 48 and the heating and fixing roller 41, and the toner 48 is not deposited on the heating and fixing roll 41 but fixed to the sheet 41.

In such an image fixing device as described, in order to prevent an occurrence of a clearance between outer surface of the endless belt 55 and the heating and fixing roll 41, it can be considered that the pressure Pn applied to the belt nip by the pressure applying member 51 is fulfilled with the conditions shown in (1) below.

$$Pn \geqq Po(Tn/To-1) \quad (1)$$

When the fixing temperature within the belt nip is 150° and the environmental temperature To is 20° C., the pressure Pn need be 0.44 kgf/cm$^2$ or more from the above-described formula (1) the present embodiment, the contact pressure of the pressure applying member 51 is 0.56 kgf/cm$^2$ whereby the pressure Pn within the belt nip is also 0.56 kgf/cm$^2$ to prevent a clearance from occurring.

However, if an area where the endless belt 55 is pressed by the pressure applying member 51 is excessively short, the sheet 47 moves out of a portion of the belt nip being pressed by the pressure applying member 51 before the toner 48 assumes a visco-elastic flow state, and air and warrior vapor expanded from the sheet 47 and the toner 48 are leached at the succeeding portion within the belt nip to form foams.

So, the length formed by pressing the endless belt 55 by the pressure applying member 51 (the nip width formed by pressing by the pressure applying member 51) is changed and the experiment for examining the presence or absence of occurrence of the disturbance of deviation, blur or the like of the image was conducted. The experimental results are given in Table 1.

In Table 1, "poor" represents the occurrence of the disturbance of the image that can be visually recognized on the sheet 47; "fair" represents the occurrence of the disturbance of the image which is not visible but can be recognized when enlarged; and "good" represents the best condition in which the disturbance of the image is not found even if being enlarged. It has been found in this experiment that first, in order

TABLE 1

| Pressure of pressure applying member 51 | Nip width pressed by pressure applying member 51 (mm) | | |
|---|---|---|---|
| (kgf/cm$^2$) | 6 | 10 | 14 |
| 0 | poor | poor | poor |
| 0.40 | poor | fair | fair |
| 0.45 | fair | good | good |
| 0.50 | fair | good | good |
| 0.55 | fair | good | good |
| 0.60 | fair | good | good |

to prevent the disturbance of the image as described above, 0.45 kgf/cm$^2$ or more of the pressure Pn within the belt nip is effective.

It is understood that under the conditions that the pressure Pn within the belt nip is 0.45 kgf/cm$^2$ or more, the length formed by pressing the endless belt 55 by the pressure applying member 51 in the running direction of the endless belt 55 is not sufficient in 6 mm, and 10 mm or more is necessary. As described above, since the whole width of the belt nip (the length of the belt nip in the running direction of the endless belt 55) in the present embodiment 20 mm, it is necessary that the pressure applying member 51 presses the endless belt 55 over ½ or more of the length of the belt nip in the running direction of the endless belt 55 in order to prevent the disturbance of the image.

Further, in the case where the fixing speed is increased from 220 mm/sec to 300 mm/sec, it is necessary to set the temperature of the heating and fixing roll to 170° C. in order to fix the toner image on the recording sheet. The experiment similar to that of Table 1 was conducted under the above conditions, the results of which are given in Table 2.

TABLE 2

| Pressure of pressure applying member 51 | Nip width pressed by pressure applying member 51 (mm) | | |
|---|---|---|---|
| (kgf/cm$^2$) | 6 | 10 | 14 |
| 0 | poor | poor | poor |
| 0.40 | poor | poor | poor |
| 0.45 | poor | poor | poor |
| 0.50 | poor | fair | fair |
| 0.55 | fair | good | good |
| 0.60 | fair | good | good |

From the results of Table 2, there is a tendency that the disturbance of the image tends to occur as compared with the results of Table 1. It is considered that such a fact as described results from a high temperature of the heating and fixing roll. The lower limit value of the nip pressure Pn derived from formula (1) is 0.52 kgf/cm$^2$. In the experimental results given in Table 2, the disturbance of the image is effectively prevented in the case where the nip pressure Pn is 0.55 kgf/cm$^2$ or more. It is understood that the disturbance of the image is prevented by fulfilling the conditions derived by formula (1).

Figure 8:
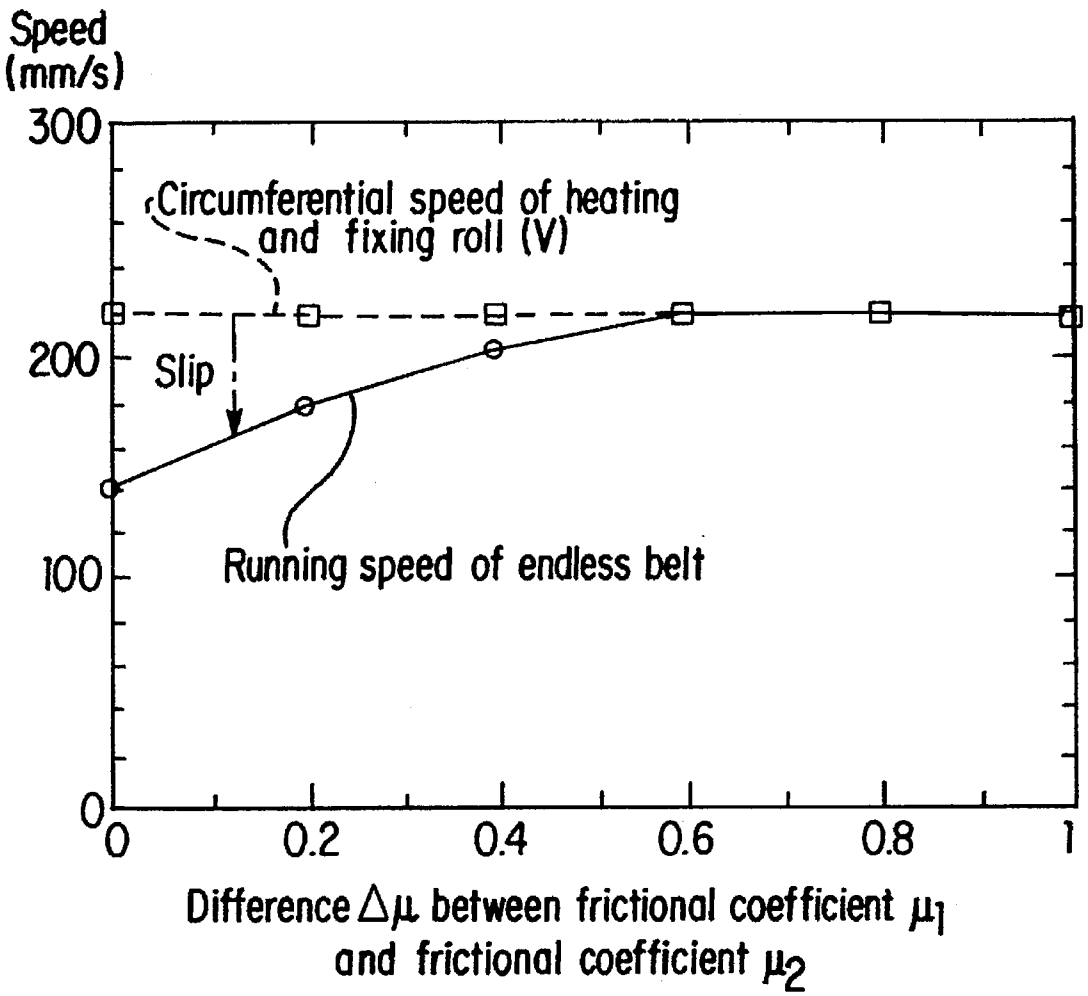
FIG. 8 is a graph showing, in the image fixing device shown in FIG. 5, the experimental results examined whether or not an endless belt can run following the rotation of a heating and fixing roll by changing a difference $\Delta\mu$ between a frictional coefficient $\mu_1$ between outer surface of the endless belt and the heating and fixing roll and a frictional coefficient $\mu_2$ between a pressure applying member and inner surface of the endless belt.

FIG. 8 shows the experimental results obtained by examination whether or not the endless belt 55 can run following the rotation of the heating and fixing roll 41 by changing the difference $\Delta\mu$ between the frictional coefficient $\mu_1$ between outer surface of the endless belt 55 and the heating and the fixing roll 41 and the frictional coefficient $\mu_2$ between the pressure applying member 41 and inner surface of the endless belt 55. In the figure, the dotted line shows the circumferential speed V of the heating and fixing roll 41, and the solid line shows the running speed of the endless belt 55. The circumferential speed V of the heating and fixing roll 41 is set to 220 mm/sec as described above.

As mentioned above, in order that the endless belt 55 runs while sliding on the pressure applying member 51 as the heating and fixing roll 41 rotates, the frictional coefficient $\mu_2$ should be smaller than the frictional coefficient $\mu_1$. As will be apparent from FIG. 8, when the difference $\Delta\mu$ between the frictional coefficient $\mu_1$ and the frictional coefficient $\mu_2$ is small, the speed of the endless belt 55 is lowered by the friction with the pressure applying member 51, and a slip occurs between the heating and fixing roll 41 and the endless belt 55. In order that the endless belt 55 runs at a speed equal to the circumferential speed V of the heating and fixing roll 41, it is preferred that the difference $\Delta\mu$ between the frictional coefficient $\mu_1$ and the frictional coefficient $\mu_2$ is 0.5 or more.

Figure 9:
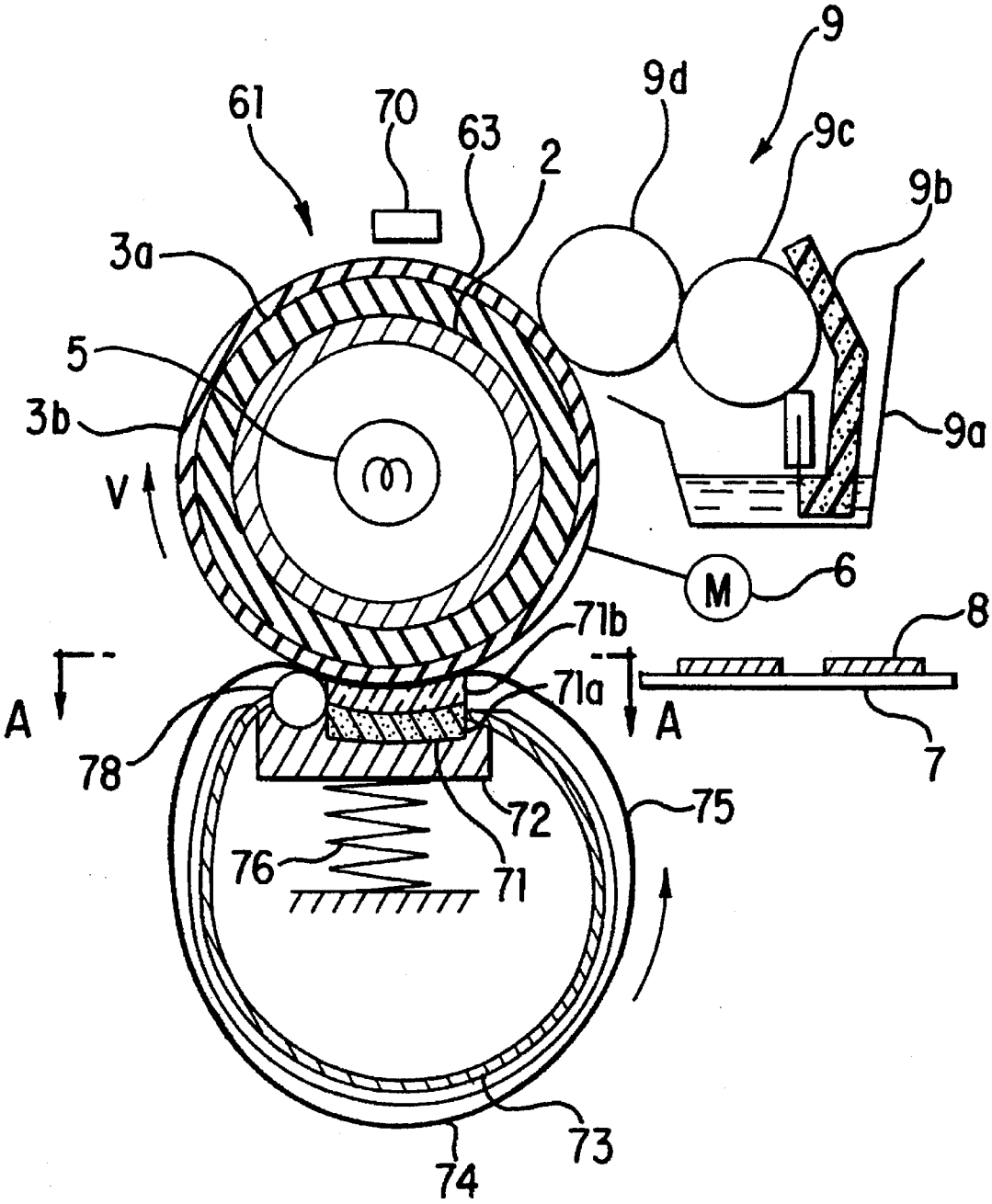
FIG. 9 is a schematic structural view of an image fixing device in a fourth embodiment according to the present invention.

FIG. 9 is a schematic structural view of an image fixing device in a fourth embodiment according to the present invention.

In this image fixing device, an endless belt 75 is supported in a non-tension state similar to the image fixing device shown in FIG. 3. However, a pressure applying member 71 and a pressing member 78 are integrally formed on a support member 72, and are pressed against a heating and fixing roll 61 by means of a spring 76 from the back of the support member 72. The pressure applying member 71 comprises an elastic layer 71*a* mounted on the support member 72 and a low friction layer 71*b* on the surface thereof.

The pressing member 78 is in the form of a roll-like member but is used in a non-rotational state. An elastic layer 63 of the heating and fixing roll 61 is strained by the pressing force of the pressure member 78. If such a strain is produced, a member having an edge or curvature not limiting to the roll-like member may be pressed.

Figure 10:
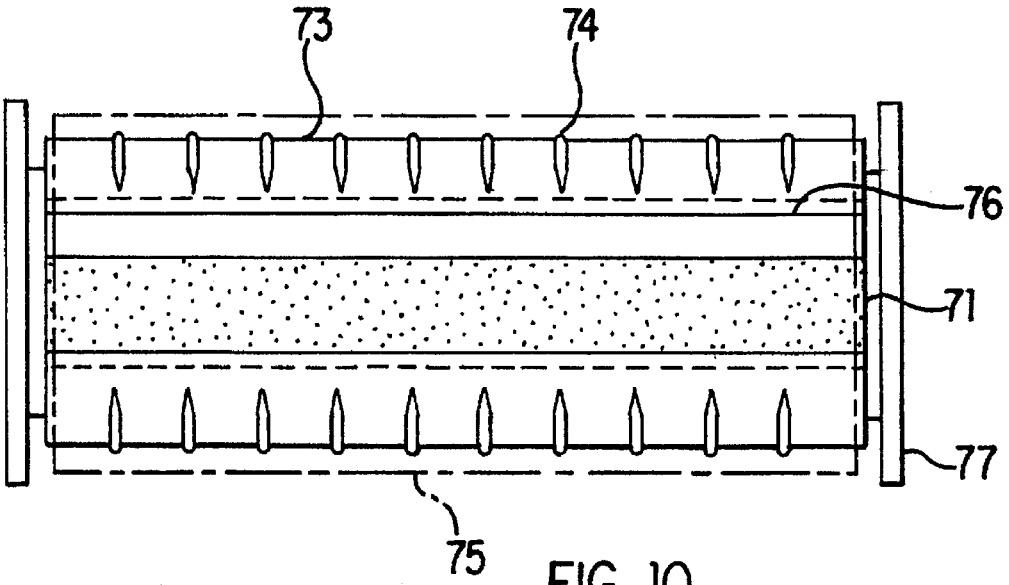
FIG. 10 is a view taken on A—A shown in FIG. 9.
Figure 11:
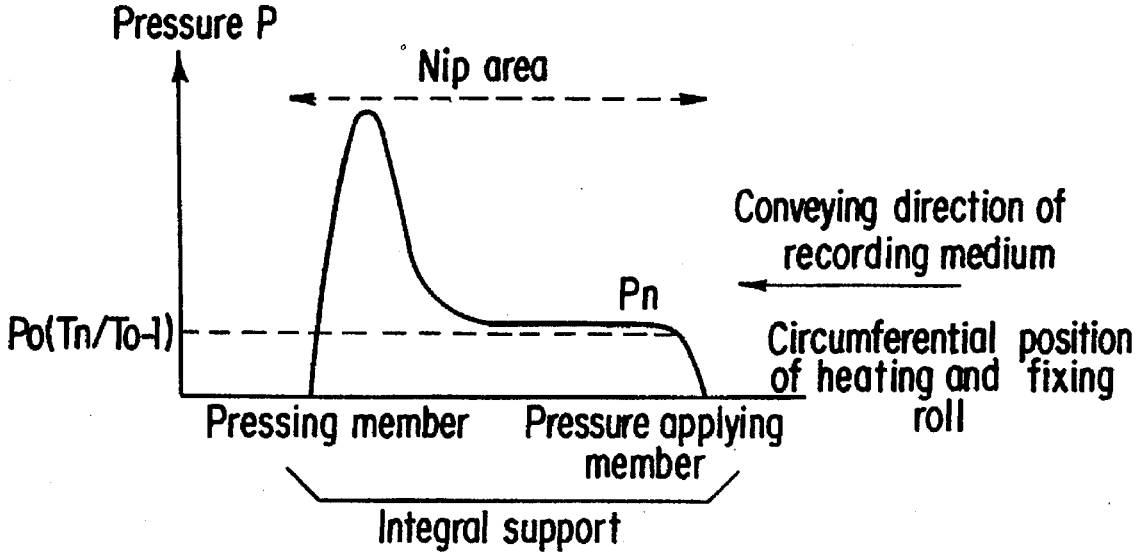
FIG. 11 is a view showing the pressure distribution acting on a belt nip area of the image fixing device shown in FIG. 9.
Figure 12:
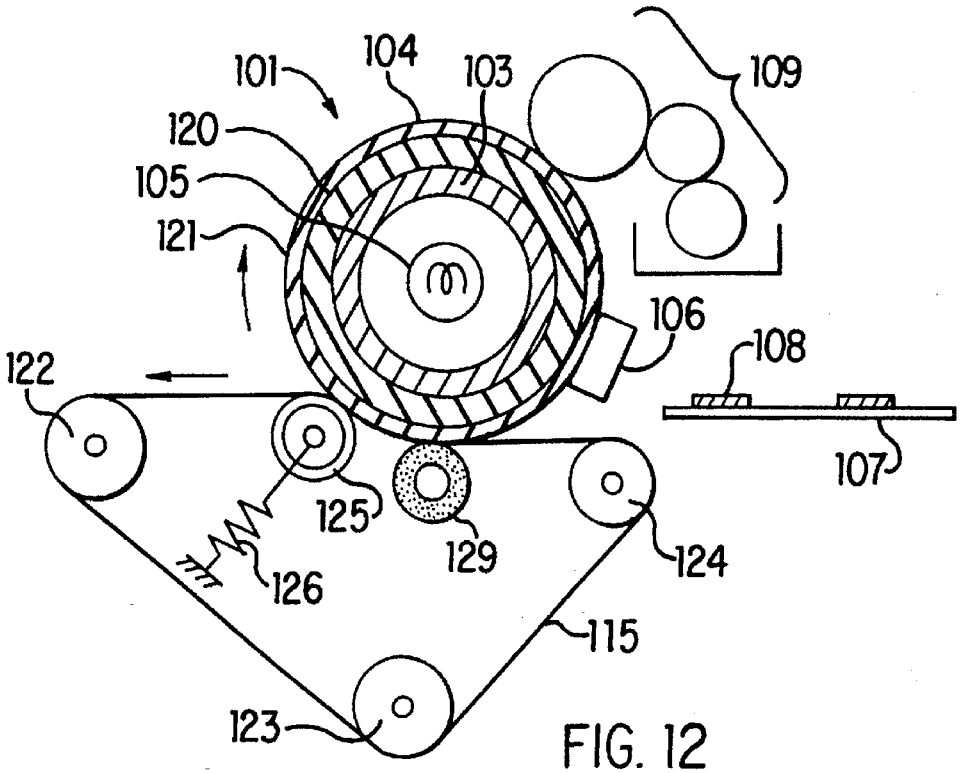
FIG. 12 Related Art
FIG. 12 is a schematic structural view showing one example of a conventional image fixing device.
Figure 13:
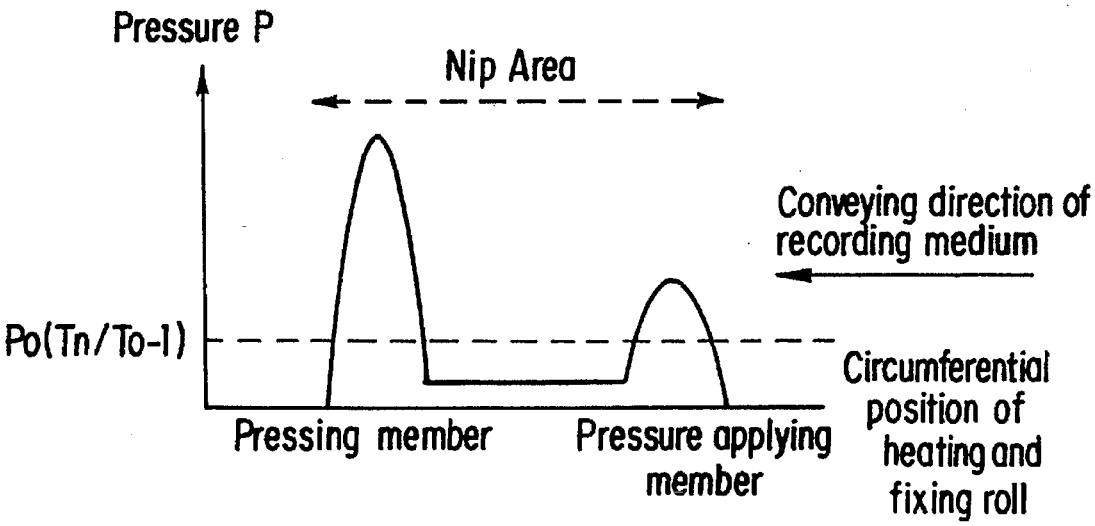
FIG. 13 Related Art
FIG. 13 is a view showing the pressure distribution acting on a belt nip area of the conventional image fixing device.
Figure 14:
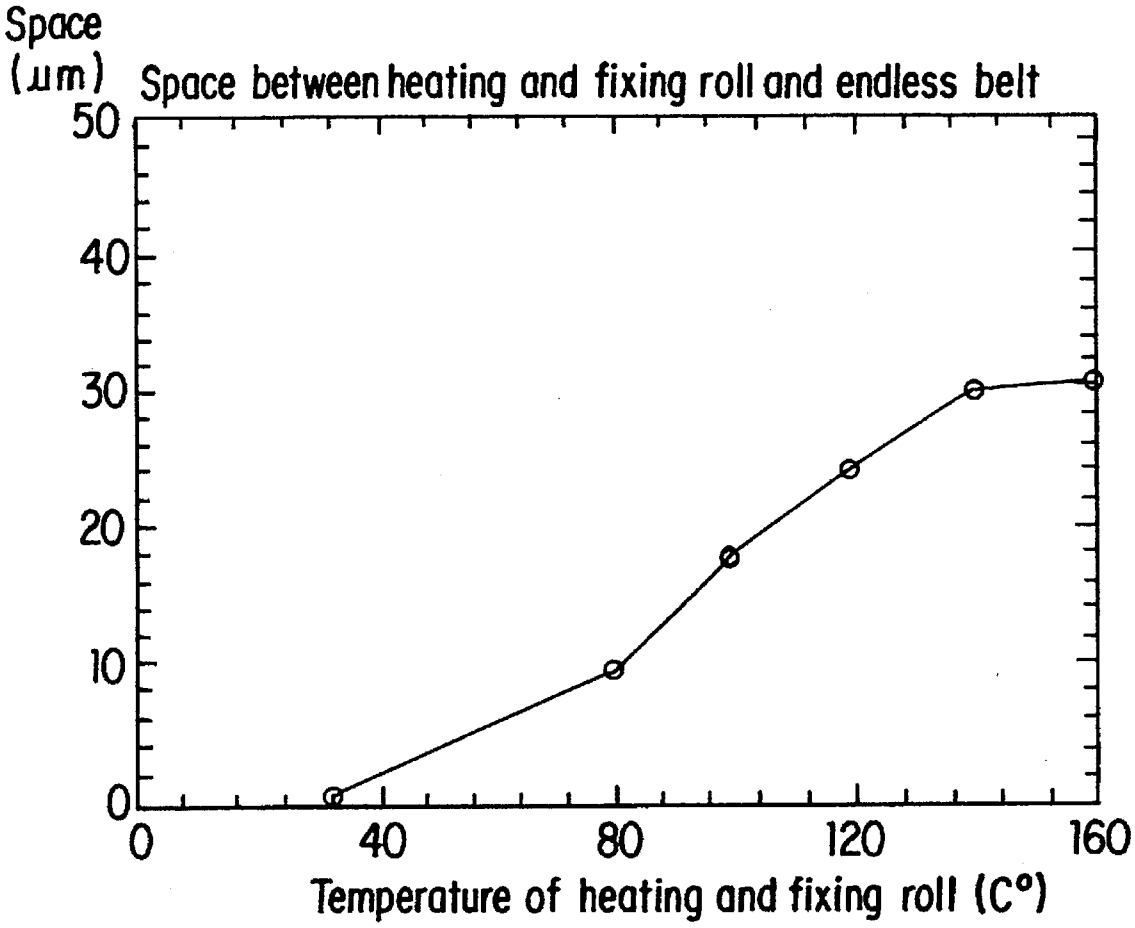
FIG. 14 Related Art
FIG. 14 is a graph showing the relationship between a fixing temperature and a space generated in the belt nip in the conventional fixing device.

The support member 72 is provided with a guide member 73 for guiding the endless belt 75, and the surface thereof is provided projections 74 along the circumferentially moving direction of the endless belt in an equally spaced relation as shown in FIG. 10. Thereby the contact area with the inner peripheral surface of the endless belt 75 is small, and the friction when the endless belt 75 runs is reduced. Flanges 77 are provided on both ends of the guide member 73 to thereby prevent the endless belt 75 from being one-sided in the axial direction of the heating and fixing roll 61 or being disengaged from the guide member Other constructions of this image fixing device is the same as those of the image fixing device shown in FIG. 3.

In such an image fixing device as described, the pressure applying member 71 and the pressing member 76 are integrally supported, and a pressing portion by the pressure applying member 71 and a pressing portion by the pressing member 78 are close in the circumferential direction of the heating and fixing roll 61. For this reason, it is possible to design the nip pressure distribution so that a portion having a small pressing force does not occur between the pressure applying member 71 and the pressing member 78, thus efficiently preventing the deviation or disturbance of the toner image.

What is claimed is:

1. An image fixing device for heating and applying pressure to a toner image on a recording medium to melt and press the toner image on the recording medium, comprising:

a heating and fixing roll for heating said recording medium;

rotating and driving means for rotating and driving said heating and fixing roll;

an endless belt arranged with respect to said recording medium on the side opposite to said heating and fixing roll; and a pressure applying member in contact with the inner surface of said endless belt and being provided with a pressing surface for pressing said endless belt against said heating and fixing roll along the surface of said heating and fixing roll;

wherein a pressure exerting a force on the pressing surface of said pressure applying member is set to a value equal to or greater than a pressure for suppressing a volume expansion of air between said heating and fixing roll and said endless belt caused by a rise in temperature of said air.

2. An image fixing device according to claim 1, wherein said endless belt is stretched over a plurality of rolls.

3. An image fixing device according to claim 1, wherein said endless belt is supported in a non-tension state.

4. An image fixing device according to claim 1, wherein the pressing surface of said pressure applying member is formed of a material having a heat resistance and formed with fine rugged portions over generally the whole surface.

5. An image fixing device according to claim 1, wherein the pressing surface of said pressure applying member is formed of a member in which a substrate formed of heat resistant fibers is coated or impregnated with a heat resistant resin.

6. An image fixing device according to claim 5, wherein said heat resistant fibers are glass fibers, and said heat resistant resin is fluoroplastic.

7. An image fixing device according to claim 1, wherein a frictional coefficient $\mu_2$ between said pressure applying member and inner surface of said endless belt is smaller than a frictional coefficient $\mu_1$ between said heating and fixing roll and outer surface of said endless belt.

8. An image fixing device for heating and applying pressure to a toner image on a recording medium to melt and press the toner image on the recording medium, comprising:

a heating and fixing roll for heating said recording medium;

rotating and driving means for rotating and driving said heating and fixing roll;

an endless belt arranged with respect to said recording medium on the side opposite to said heating and fixing roll; and a pressure applying member in contact with the inner surface of said endless belt and being provided with a pressing surface for pressing said endless belt against said heating and fixing roll along the surface of said heating and fixing roll;

wherein the pressure exerting the force on the pressing surface of said pressure applying member is set so as to establish a relationship of $$Pn \geqq Po(Tn/To-1)$$

between the pressure Pn within a belt nip caused by pressing said endless belt along the surface of said heating and fixing roll, the temperature Tn of said heating and fixing roll, the atmospheric pressure Po and the environmental temperature To.

9. An image fixing device according to claim 8, wherein said endless belt is stretched over a plurality of rolls.

10. An image fixing device according to claim 8, wherein said endless belt is supported in a non-tension state.

11. An image fixing device according to claim 8, wherein the pressing surface of said pressure applying member is formed of a material having a heat resistance and formed with fine rugged portions over generally the whole surface.

12. An image fixing device according to claim 8, wherein the pressing surface of said pressure applying member is formed of a member in which a substrate formed of heat resistant fibers is coated or impregnated with a heat resistant resin.

13. An image fixing device according to claim 12, wherein said heat resistant fibers are glass fibers, and said heat resistant resin is fluoroplastic.

14. An image fixing device according to claim 8, wherein a frictional coefficient $\mu_2$ between said pressure applying member and inner surface of said endless belt is smaller than a frictional coefficient $\mu_1$ between said heating and fixing roll and outer surface of said endless belt.

15. An image fixing device for heating and applying pressure to a toner image on a recording medium to melt and press the toner image on the recording medium, comprising:

a heating and fixing roll for heating said recording medium, said heating and fixing roll having an elastic layer in the vicinity of the surface thereof;

rotating and driving means for rotating and driving said heating and fixing roll;

an endless belt arranged with respect to said recording medium on the side opposite to said heating and fixing roll;

a pressure applying member in contact with the inner surface of said endless belt and being provided with a pressing surface for pressing said endless belt against said heating and fixing roll along the surface of said heating and fixing roll; and a pressing member disposed internally of said endless belt for pressing said endless belt against said heating and fixing roll downstream a pressing position of said pressure applying member in the rotational direction of said heating and fixing roll to strain said elastic layer of said heating and fixing roll, wherein the pressure exerting the force on the pressing surface of said pressure applying member is set to a value equal to or greater than a pressure for suppressing a volume expansion of air between said heating and fixing roll and said endless belt caused by a rise in temperature of said air.

16. An image fixing device according to claim 15, wherein the pressure exerting the force on the pressing surface of said pressure applying member is set so as to establish a relationship of $$Pn \geqq Po(Tn/To-1)$$

between the pressure Pn within a belt nip caused by pressing said endless belt along the surface of said heating and fixing roll, the temperature Tn of said heating and fixing roll, the atmospheric pressure Po and the environmental temperature To.

17. An image fixing device according to claim 15, wherein said pressing member is a roll rotatably supported, and said endless belt is stretched over said heating and fixing roll and at least one support roll.

18. An image fixing device according to claim 15, wherein said pressing member is supported integral with said pressure applying member, and a range in which said pressing member presses said endless belt against said heating and fixing roll and a range in which said pressure applying member presses said endless belt against said heating and fixing roll are generally continuous to the circumferential direction of said heating and fixing roll.

19. An image fixing device according to claim 15, wherein the circumferential length of said heating and fixing roll in which said pressure applying member presses said endless belt against said heating and fixing roll is set from a position at which said endless belt is placed in contact with said heating and fixing roll to a position at which the viscosity of said toner is heated to a temperature at which a visco-elastic flow occurs.

20. An image fixing device according to claim 15, wherein the circumferential length of said heating and fixing roll in which said pressure applying member presses said endless belt against said heating and fixing roll is ½ or more of the circumferential length of said heating and fixing roll till said endless belt is moved away after the pressure applying member has been placed in contact with said heating and fixing roll.

* * * * *